US005078962A

United States Patent [19]

Regazzoni et al.

[11] Patent Number: 5,078,962

[45] Date of Patent: Jan. 7, 1992

[54] HIGH MECHANICAL STRENGTH MAGNESIUM ALLOYS AND PROCESS FOR OBTAINING THESE BY RAPID SOLIDIFICATION

[75] Inventors: Gilles Regazzoni; Gilles Nussbaum, both of Grenoble, France; Haavard T. Gjestland, Porsgrunn, Norway

[73] Assignees: Pechiney Electrometallurgie, Courbevoie, France; Norsk, Hydro A.S., Oslo, Norway

[21] Appl. No.: 571,226

[22] Filed: Aug. 23, 1990

[30] Foreign Application Priority Data

Aug. 24, 1989 [FR] France ..... 89 11357

[51] Int. Cl.[5] ..... C23C 23/02

[52] U.S. Cl. ..... 420/402; 148/2

[58] Field of Search ..... 420/402; 148/2

[56] References Cited

U.S. PATENT DOCUMENTS 4,765,954 8/1988 Das et al. ..... 420/403

*Primary Examiner*—Upendra Roy

*Attorney, Agent, or Firm*—Dennison, Meserole, Pollack & Scheiner

[57] ABSTRACT

The invention relates to high mechanical strength magnesium alloys and to a process for producing these alloys by fast solidification and consolidation by drawing generally exceeding 400 or 500 MPa, an elongation at break of generally at least 5% and a chemical composition by weight within the following limits:

| | |
|---|---|
| Aluminium | 2–11% |
| Zinc | 0–12% |
| Manganese | 0–1% |
| Calcium | 0.5–7% |
| Rare Earths | 0.1–4% |

with the main impurities and the residue being magnesium, their structure being constituted by grains with a mean size below 3 μm and intermetallic compounds with a size below 2 μm precipitated at the grain boundaries.

19 Claims, No Drawings

HIGH MECHANICAL STRENGTH MAGNESIUM ALLOYS AND PROCESS FOR OBTAINING THESE BY RAPID SOLIDIFICATION

BACKGROUND OF THE INVENTION

The present invention is linked to claims 1 and 2 of the main French patent application 88-02885 and relates to high mechanical strength magnesium alloys and to their production process.

SUMMARY OF THE INVENTION

The alloys of the invention have a breaking load of at least 290 MPa, but more particularly at least 400 MPa and an elongation at break of at least 5% and which, in combination, have the following characteristics:

a weight composition between the following limits:

| | | |
|---|---|---|
| Aluminium | 2–11 and preferably | 3 to 9% |
| Zinc | 0–12 and preferably | 0 to 3% |
| Manganese | 0–1 and preferably | 0.1 to 0.2% |
| Calcium | 0.5–7 and preferably | 1 to 7% |
| Rare Earths (RE) | 0.1–4 and preferably | 0.5 to 2.5% |

with the following contents of the main impurities:

| | |
|---|---|
| Silicon | <0.6% |
| Copper | <0.2% |
| Iron | <0.1% |
| Nickel | <0.01% |

the remainder being magnesium;

a mean grain size below 3 μm;

they are constituted by a homogeneous matrix reinforced by particles of intermetallic compounds precipitated at the grain boundaries $Mg_{17}Al_{12}$, optionally $Al_2Ca$, as a function of the Ca concentration, $Mg_{32}(Al,Zn)_{49}$ if Zn is present in the alloy, Mg-RE and/or Al-RE, as a function of the content and/or the nature of the rare earth, said particles having a mean size below 2 μm and preferably below 0.5 μm. This structure remains unchanged after keeping for 24 h at 300° C. When Mn is present, it is an at least quaternary element and its minimum weight content is preferably 0.1%.

Such alloys also have an improved corrosion resistance. Thus, unlike the alloys described in the main French patent application 88-02885 and its first certificate of addition 89-01913, which have local corrosions (e.g. pitting, corrosion in the form of wear ridges and grooves, etc.) which can lead in the long term to weakness areas, they have a corrosion which is at least as low, but which is also more homogeneous. Thus, in the requisite proportions, the alloys according to the invention contain both calcium and rare earths, particularly Y (included here as a RE), Nd, Ce, La, Pr or misch metal (MM). These additions make it possible to improve the mechanical characteristics of the magnesium-based alloys obtained after rapid tempering and compaction by drawing, including drawing temperatures which can reach or even exceed 350° C., whilst still retaining an interesting level for the characteristics. Such a property in particular makes it possible to increase the drawing or extrusion rates and speeds, the alloy being able to withstand the heating resulting therefrom without losing its characteristics, so that the productivity levels can be improved.

DETAILED DESCRIPTION OF THE INVENTION

In the final alloy, the calcium can be in the form of dispersoids of $Al_2Ca$ precipitated at the grain boundaries and/or in solid solution. The particles of the intermetallic compound $Al_2Ca$ appear when the Ca concentration is adequate. Their size is below 1 μm and preferably below 0.5 μm. There is no need for Mn to be present. This also applies with respect to the RE, the dispersoids appear as from certain concentrations inherent in each of the rare earths. It is also possible for other intermetallic particles, e.g. based on Al and Mn and which are of a very small size (approximately 40 to 50 nanometers) to be dispersed in the magnesium grains.

According to the invention, the alloys are obtained by the processes and different embodiments described in the main patent, which form an integral part of the present description. The alloy in the liquid state undergoes a fast solidification at a speed at least equal to $10^4$K $sec^{-1}$ and generally below $10^6$K $sec^{-1}$, so as to obtain a solidified product, whereof at least one of the dimensions is below 150 μm, said product then being directly consolidated by precompacting and compacting or by direct compacting, compacting taking place at between 200° and 350° C. It is preferable for the solidified product to undergo no other conditioning operation such as grinding before being consolidated by precompacting and/or compacting, said operation possibly reducing the mechanical characteristics of the consolidated alloy obtained.

The rapid cooling for the solidification can either be obtained by casting in strip form on a so-called "hyper-tempering on roller" apparatus, which is conventionally constituted by a vigorously cooled drum on to which is cast the metal; or by melting an electrode or a liquid metal jet, the liquid metal then being mechanically divided or atomized and sprayed onto a vigorously cooled surface which is kept free; or by atomization of the liquid alloy in an inert gas jet.

The first two procedures make it possible to obtain a solid in the form of strips, scales or small plates, whilst the latter gives powder. These processes are described in detail in the main patent application and do not form part of the present invention as such. The rapidly solidified product can be vacuum degassed at a temperature equal to or below 350° C. prior to consolidation.

The consolidation, which is also described in the main application is performed, according to the invention, directly on the solidified products and in particular directly on the scales or plates. In order to preserve the fine, original structure obtained by fast solidification, it is necessary to ensure that there is no long exposure to high temperatures. Therefore tepid drawing or extrusion is used, which makes it possible to minimize the high temperature passage time.

The drawing temperature is between 200° and 350° C. The drawing ratio is generally between 10 and 40 and preferably between 10 and 20. The ram advance speed is preferably between 0.5 and 3 mm/sec, but can also be higher.

As described in the main application, prior to consolidation, the solid product can be directly introduced into the press container, or following precompacting at a temperature at the most 350° C. with introduction into a sheath made from Mg or its alloys, or Al or its alloys, which is itself introduced into the said container.

As a variant, it is possible to perform other compacting processes not leading to a rise in the temperature of the product beyond 350° C. These optional processes include hydrostatic drawing, forging, rolling and superplastic forming.

Thus, the process according to the invention unexpectedly makes it possible to obtain a consolidated magnesium alloy which, as has already been described, has a fine structure (grain smaller than 3 μm) reinforced by intermetallic compounds and the excellent mechanical characteristics remain unchanged in the same way as the structure of said alloy, after keeping for a long time at a temperature reaching and even exceeding 350° C. The corrosion resistance is improved in uniformity and weight loss (which is reduced).

EXAMPLES

Several alloys were produced under fast solidification conditions identical to those used in the examples of the main application: wheel casting, peripheral wheel speed 10 to 40 m/s, cooling speed between $10^5$ and $10^6$K $s^{-1}$. The strips obtained were then directly introduced into the container of a drawing or extrusion press in order to obtain a consolidated alloy on which characterization tests were carried out: microscopic examination, measurement of the mechanical characteristics, corrosion resistance (measured by tempering in a 5% NaCl solution over 3 days).

Table 1 gives the operating characteristics for the drawing process and the characteristics of the alloys obtained:

Hv = Vickers hardness expressed in kg/mm²

TYS = yield strength measured with 0.2% elongation in MPa

UTS = breaking load in MPa (ultimate tensile strength)

e = elongation at break as a %

Corrosion = weight loss in mg/cm²/day (m.c.d)—appearance of corrosion.

prior art and are partly taken from French certificate of addition FR 89-01913.

Tests 4 and 23 relate to alloys treated by fast solidification and consolidation with a composition identical to that of AZ91. Tests 7-9-11-12 relate to alloys containing Ca also obtained by fast solidification and consolidation. The results obtained with regards to the corrosion and/or mechanical characteristics of these alloys are inferior to those of the alloys according to the invention. Samples 23, 4 and 7 are subject to heterogeneous corrosion with relatively high weight losses. Samples 4 and 7 also have mechanical characteristics well below those of the alloys according to the invention. Sample 11 has uniform corrosion, but a high weight loss comparable with that of alloy 20 and mechanical characteristics decidely inferior to those of the latter and also to those of alloys 21 and 22. Finally, sample 12 has an excellent corrosion resistance, but the mechanical characteristics are well below those of the alloys according to the invention.

Thus, according to the invention, the addition of rare earths permits a higher level for the mechanical characteristics, improves the uniformity of the corrosion (test 20-21-22) and reduces the weight loss (tests 21-22). It should be noted that the mechanical characteristics are obtained by consolidation drawing at 300° C. and that the difference compared with the prior art would increase if the drawing in the tests for the latter was carried out at such a high temperature.

Thus, the invention makes it possible to obtain alloys with an improved corrosion resistance (uniform corrosion and generally lower weight loss), whilst giving improved mechanical characteristics for a high drawing temperature. The latter advantage is important because such temperatures make it possible to draw sections having large dimensions and/or increase the drawing speeds, whilst still retaining good mechanical characteristics. It should also be noted that this high drawing temperature makes it possible to improve the fatigue strength of alloys according to the invention.

| | According to invention | | | According to prior art | | | | | |
|---|---|---|---|---|---|---|---|---|---|
| N° and test | 20 | 21 | 22 | 4 | 23 | 7 | 9 | 11 | 12 |
| Alloy composition wt % (1) | | | | AZ91 | AZ91 | | | | AZ91 + Ca 2% |
| Al | 5 | 7 | 5 | 9 | 9 | 9 | 5 | 5 | 9 |
| Zn | 0 | 1.5 | 0 | 1 | 1 | 0 | 0 | 0 | 0.6 |
| Mn | 0 | 0 | 0 | 0.2 | 0 | 0 | 0 | 0.5 | 0.2 |
| Ca | 6.5 | 4.5 | 6.5 | 0 | 0 | 1 | 3.7 | 3.5 | 2 |
| RE | 2(Nd) | 1(Nd) | 2(MM)(2) | 0 | 0 | 0 | 0 | 0 | 0 |
| T° drawing °C. | 300 | 300 | 300 | 200 | 300 | 200 | 250 | 300 | 250 |
| Drawing ratio | 20 | 20 | 20 | 20 | 20 | 20 | 20 | 20 | 20 |
| Ram speed mm/sec | 0.5 | 0.5 | 0.5 | 0.5 | 0.5 | 0.5 | 0.5 | 0.5 | 0.5 |
| Hv kg/mm2 | 132 | 134 | 138 | 129 | 105 | 139 | 124 | 100 | 125 |
| TYS (0,2) MPa | 564 | 535 | 565 | 457 | 330 | 500 | 538 | 483 | 427 |
| UTS MPa | 593 | 574 | 598 | 517 | 380 | 555 | 567 | 492 | 452 |
| e % | 2 | 4.7 | 1.6 | 11.1 | 20 | 6.9 | 5.2 | 8.0 | 5.4 |
| Corrosion: | | | | | | | | | |
| mg/cm2/day | 0.56 | 0.25 | 0.2 | 0.4 | 0.4 | 0.35 | 0.5 | 0.65 | 0.075 |
| Corrosion type | Uniform | uniform | uniform | filiform | filiform | deep pitting | uniform | uniform | uniform |

(1) The residue being Mg
(2) MM: Misch Metal

This table includes tests 20-21-22 illustrating the present invention, whilst tests 4-23-7-9-11-12 illustrate the

What is claimed is:

1. A magnesium-based alloy with a breaking load at least equal to 290 MPa and an elongation at break of generally at least 5%, comprising by weight:

| | |
|---|---|
| Aluminum | 2–11% |
| Zinc | 0–12% |
| Manganese | 0–1% |
| Calcium | 0.5–7%; |
| Rare Earths (RE) | 0.1–4% |

with the following contents of the main impurities:

| | |
|---|---|
| Silicon | <0.6% |
| Copper | <0.2% |
| Iron | <0.1% |
| Nickel | <0.01% |

| | |
|---|---|
| Silicon | <0.6% |
| Copper | <0.2% |
| Iron | <0.1% |
| Nickel | <0.01% |

the remainder being magnesium;

said alloy having a mean particle size below 3 μm and constituted by a homogeneous matrix reinforced by particles of an intermetallic compound $Mg_{17}Al_{12}$, said particles having a mean size below 1 μm, which are precipitated at the grain boundaries, said structure remaining unchanged if kept at 24 300° C. for about 24 h, said alloy being formed by rapid solidification from the liquid state at a rate greater than $10^4$°K./sec$^{-1}$.

2. Alloy according to claim 1, characterized in that its weight composition is within the following limits:

| | |
|---|---|
| Aluminum | 3–9% |
| Zinc | 0–3% |
| Manganese | 0.1–0.2% |
| Calcium | 1–7% |
| RE | 0.5–2.5% |

with the following contents of the main impurities:

| | |
|---|---|
| Silicon | 0.1–0.6% |
| Copper | <0.2% |
| Iron | <0.1% |
| Nickel | <0.01% |

the remainder being magnesium.

3. Process for the production of an alloy according to claim 1 comprising the steps of subjecting said alloy, in the liquid state, to rapid cooling at a speed of at least $10^4$K sec$^{-1}$, so as to obtain a solidified product, whereof at least one of the dimensions is below 150 μm and which is then directly compacted at a temperature between 200° and 350° C.

4. The magnesium-based alloy of claim 1 further comprising an intermetallic compound $Al_2Ca$ as a function of the concentration of Ca, $Mg_{32}(Al,Zn)_{49}$, if Zn is present in the alloy, Mg-RE and/or Al-RE, as a function of the content and/or nature of the rare earths.

5. The magnesium-based alloy of claim 1 wherein the particles of the intermetallic compounds $Mg_{17}Al_{12}$ are below 0.5 μm.

6. The magnesium-based alloy of claim 1 wherein said particles have a mean size below 0.5 μm.

7. Alloy according to either of claims 1 or 2, wherein the rare earths are selected from the group consisting of Y, Nd, Ce, La, Pr and Misch Metal.

8. Process according to claim 3 wherein the rapid cooling is obtained by casting or pouring onto a highly cooled moving surface in the form of a continuous strip with a thickness of below 150 μm.

9. Process according to claim 3 wherein the rapid cooling is obtained by spraying the liquid alloy into a highly cooled surface which is kept free.

10. Process according to claim 3 wherein the fast cooling is obtained by atomizing the liquid alloy by means of an inert gas jet.

11. Process according to one of the claims 3, 8, 9, or 10, wherein the rapidly solidified product is compacted by a procedure selected from press drawing, hydrostatic drawing, rolling, forging and superplastic deformation.

12. Process according to claim 11, wherein the rapidly solidified product is compacted by press drawing at a temperature between 200° and 350° C., with a drawing ratio between 10 and 40 and with a press ram advance speed between 0.5 and 3 mm/second.

13. Process according to claim 11, wherein the rapidly solidified product is compacted by press drawing at a temperature between 200° and 350° C., with a drawing ratio between 10 and 20 and with a press ram advance speed between 0.5 and 3 mm/second.

14. Process according to claim 12, wherein the rapidly cooled product is introduced rapidly into the container of the drawing press.

15. Process according to claim 12, wherein the rapidly cooled product is previously introduced into a metal sheath made from aluminum, magnesium or an alloy based on one or other of these two metals.

16. Process according to claim 9, wherein the rapidly solidified product is firstly precompacted in the form of a billet at a temperature of at the most 350° C.

17. Process according to claim 9, wherein the rapidly cooled product is degassed in vacuo at a temperature equal to or below 350° C. prior to consolidation.

18. Process according to claim 13, wherein the rapidly cooled product is previously introduced into a metal sheath made from aluminum, magnesium or an alloy based on one or other of these two metals.

19. Process according to claim 13, wherein the rapidly cooled product is degassed in vacuo at a temperature equal to or below 350° C. prior to consolidation.

* * * * *